US009982552B2

(12) United States Patent
Nakano et al.

(10) Patent No.: US 9,982,552 B2
(45) Date of Patent: May 29, 2018

(54) PRESSURIZED INCINERATION FACILITY AND PRESSURIZED INCINERATION METHOD

(71) Applicants: Tsukishima Kikai Co., Ltd., Tokyo (JP); Sanki Engineering Co., Ltd., Tokyo (JP)

(72) Inventors: Ken Nakano, Tokyo (JP); Yutaka Hirata, Tokyo (JP); Yuki Asaoka, Tokyo (JP); Kazuyoshi Terakoshi, Tokyo (JP); Toshiki Kobayashi, Tokyo (JP); Takafumi Yamamoto, Tokyo (JP); Takamitsu Kanno, Tokyo (JP); Kunihiko Koga, Tokyo (JP); Tomokazu Suyama, Tokyo (JP)

(73) Assignees: TSUKISHIMA KIKAI CO., LTD., Tokyo (JP); SANKI ENGINEERING CO., LTD., Tokyo (JP)

( * ) Notice: Subject to any disclaimer, the term of this patent is extended or adjusted under 35 U.S.C. 154(b) by 392 days.

(21) Appl. No.: 14/764,365

(22) PCT Filed: Jan. 27, 2014

(86) PCT No.: PCT/JP2014/051632
§ 371 (c)(1),
(2) Date: Jul. 29, 2015

(87) PCT Pub. No.: WO2014/119499
PCT Pub. Date: Aug. 7, 2014

(65) Prior Publication Data

US 2015/0369474 A1 Dec. 24, 2015

(30) Foreign Application Priority Data

Jan. 30, 2013 (JP) ..... 2013-015556

(51) Int. Cl.
*F01D 11/04* (2006.01)
*F23L 5/02* (2006.01)
(Continued)

(52) U.S. Cl.
CPC ..... *F01D 11/04* (2013.01); *F23C 10/18* (2013.01); *F23L 5/02* (2013.01); *F05D 2220/40* (2013.01);
(Continued)

(58) Field of Classification Search
CPC ..... F01D 11/04; F01D 11/06; F05D 2220/40; F23L 2900/05021
See application file for complete search history.

(56) References Cited

U.S. PATENT DOCUMENTS 3,818,846 A * 6/1974 Reese ..... B01D 45/00 110/186
4,648,790 A * 3/1987 Horler ..... F01D 5/00 415/112
(Continued)

FOREIGN PATENT DOCUMENTS

JP A60173316 9/1985
JP A63106326 5/1988
(Continued)

OTHER PUBLICATIONS

International Search Report for PCT/JP2014/051632.
Japanese Office Action in corresponding Japanese Patent Application No. 2013-015556 dated May 10, 2016.

*Primary Examiner* — David J Laux
(74) *Attorney, Agent, or Firm* — Hoffmann & Baron, LLP

(57) ABSTRACT

A pressurized incineration facility (100, 200) includes: a pressurized incinerator (1) which incinerates a processing object (P) under a pressure increased by compressed air (A);
(Continued)

a turbocharger (5) which produces the compressed air by being rotationally driven by combustion exhaust gas (G) of the pressurized incinerator; and a seal device (5*i*) which jets seal gas (S) to a rear surface (5*a*1) of a turbine impeller (5*a*) of the turbocharger.

11 Claims, 6 Drawing Sheets

(51) Int. Cl.

| | |
|---|---|
| ***F23C 10/18*** | (2006.01) |
| *F23C 10/16* | (2006.01) |
| *F23G 5/30* | (2006.01) |

(52) U.S. Cl.
CPC ..... *F23C 10/16* (2013.01); *F23G 5/30* (2013.01); *F23G 2200/00* (2013.01); *F23G 2202/30* (2013.01); *F23G 2203/502* (2013.01); *F23L 2900/05021* (2013.01)

(56) References Cited

U.S. PATENT DOCUMENTS

| | | | | |
|---|---|---|---|---|
| 4,722,663 | A | 2/1988 | Swearingen | |
| 6,862,877 | B1 * | 3/2005 | James | F02C 3/205 110/264 |
| 2012/0328418 | A1 * | 12/2012 | Yang | F01D 25/186 415/170.1 |
| 2013/0011276 | A1 | 1/2013 | Patel et al. | |

FOREIGN PATENT DOCUMENTS

| | | |
|---|---|---|
| JP | A07119477 | 5/1995 |
| JP | A10008903 | 1/1998 |
| JP | A2000265845 | 9/2000 |
| JP | A2005098267 | 4/2005 |
| JP | A2008025966 | 2/2008 |
| JP | B4274659 | 6/2009 |
| JP | A2009174442 | 8/2009 |
| JP | A2009185807 | 8/2009 |
| JP | A2009236068 | 10/2009 |
| JP | A2011137575 | 7/2011 |
| JP | A2011236795 | 11/2011 |

* cited by examiner

PRESSURIZED INCINERATION FACILITY AND PRESSURIZED INCINERATION METHOD

This application is the U.S. National Phase of, and Applicants claim priority from, International Patent Application Number PCT/JP2014/051632, filed Jan. 27, 2014, which claims priority from Japanese Patent Application No. JP2013-015556, filed Jan. 30, 2013, which is incorporated herein by reference.

TECHNICAL FIELD

The present invention relates to a pressurized incineration facility and a pressurized incineration method.

Priority is claimed on Japanese Patent Application No. 2013-015556, filed Jan. 30, 2013, the content of which is incorporated herein by reference.

BACKGROUND

Patent Document 1 shown below discloses a pressurized incinerator facility and a start-up method thereof, in which a blower used to start up a turbocharger is provided on the upstream side of an air inlet pipe of the turbocharger in order to reduce the production cost or the running cost thereof. The pressurized incinerator facility includes the turbocharger which produces compressed air by using high-temperature exhaust gas exhausted from a pressurized-fluidized bed incinerator and which supplies the compressed air to the pressurized-fluidized bed incinerator. The pressurized incinerator facility supplies start-up air from the blower to a compressor of the turbocharger at the time of start-up of the facility.

Furthermore, as an example of the technology of a turbine-side gas seal for a bearing (described later) of the turbocharger, for example, Patent Document 2 discloses a technology to prevent leakage (leakage into the bearing) of exhaust gas imported to a turbine, the leakage being prevented by a gasket which blocks and seals a gap by using gas pressure.

DOCUMENT OF RELATED ART

Patent Document

[Patent Document 1] Japanese Unexamined Patent Application, First Publication No. 2008-25966

[Patent Document 2] Japanese Unexamined Patent Application, First Publication No. 2000-265845

SUMMARY

Technical Problem

As is well known, in the turbocharger, a turbine shaft (rotary shaft) of a turbine impeller is supported by a bearing mechanism, and the bearing mechanism obtains the bearing performance thereof by lubricating oil. A gas bearing device being an example of the bearing mechanism, in which the rotary shaft is inserted into a journal bearing with a gap formed therebetween and is supported in a state of being floated by pressurized air supplied from outside of the device, is costly because the device is complicated, and has no actual example of adoption for mass production. In the pressurized incinerator facility, high-temperature exhaust gas exhausted from the pressurized-fluidized bed incinerator flows into the turbocharger so as to serve as a drive fluid, and part of the high-temperature exhaust gas may affect the lubricating oil of the bearing mechanism and may deteriorate the lubricating oil. That is, ingredients of the high-temperature exhaust gas seem to be based on an incineration object or on a fuel used for incineration, and the ingredients may contain an ingredient which deteriorates the lubricating oil of the turbocharger. In this case, since deterioration of the lubricating oil is accelerated, the exchange frequency of the lubricating oil is increased, and as a result, the running cost is increased.

The present invention has been made in view of the above circumstances, and an object thereof is to provide a pressurized incineration facility and a pressurized incineration method in which deterioration of lubricating oil of a turbocharger at least due to exhaust gas of a pressurized incinerator can be limited.

Solution to Problem

In order to accomplish the above object, a pressurized incineration facility of a first aspect of the present invention includes: a pressurized incinerator which incinerates a processing object under a pressure increased by compressed air; a turbocharger which produces the compressed air by being rotationally driven by combustion exhaust gas from the pressurized incinerator; and a seal device which jets seal gas to a rear surface of a turbine impeller of the turbocharger.

A second aspect of the present invention is that the pressure incineration facility of the first aspect further includes a blower which supplies start-up air to the pressurized incinerator at the time of start-up of the facility. In addition, the seal device is configured to obtain the start-up air of the blower at the time of start-up of the facility and to jet the start-up air to the rear surface of the turbine impeller so that the start-up air serves as the seal gas, and is configured to obtain the compressed air of the turbocharger after start-up of the facility and to jet the compressed air to the rear surface of the turbine impeller so that the compressed air serves as the seal gas.

A third aspect of the present invention is that in the second aspect, the seal device includes: a switching device which selects and discharges the start-up air at the time of start-up of the facility, and which selects and discharges the compressed air after start-up of the facility; and a seal gas flow passageway provided in the turbocharger, one end of the seal gas flow passageway being connected to a discharge port of the switching device, and another end of the seal gas flow passageway opening at a housing facing the rear surface of the turbine impeller.

A fourth aspect of the present invention is that in the first aspect, the seal device includes a seal gas flow passageway which is provided in the turbocharger and which guides the compressed air to a housing facing the rear surface of the turbine impeller so that the compressed air serves as the seal gas.

A fifth aspect of the present invention is that in any one of the first to fourth aspects, the seal device includes a plurality of jetting ports which jet the seal gas to a plurality of parts of the rear surface of the turbine impeller.

A sixth aspect of the present invention is that in any one of the first to fifth aspects, the seal device includes a jetting port which jets the seal gas to the rear surface of the turbine impeller toward an outer periphery of the turbine impeller.

A seventh aspect of the present invention is that in any one of the first to sixth aspects, the seal device includes a jetting port which jets the seal gas in a circular pattern coaxial with the turbine impeller to the rear surface of the turbine impeller.

A pressurized incineration method of an eighth aspect of the present invention includes steps of: incinerating a processing object under a pressure increased by supplying a pressurized incinerator with compressed air produced by a turbocharger; producing the compressed air by rotationally driving the turbocharger by combustion exhaust gas of the pressurized incinerator; and jetting seal gas to a rear surface of a turbine impeller of the turbocharger.

Effects

According to the present invention, since seal gas is jetted to a rear surface of a turbine impeller of a turbocharger, it is possible to limit or prevent inflow of exhaust gas of a pressurized incinerator into a bearing mechanism of the turbocharger. Therefore, according to the present invention, it is possible to limit or prevent deterioration of lubricating oil in the bearing mechanism of the turbocharger.

DESCRIPTION OF EMBODIMENTS

Hereinafter, an embodiment of the present invention is described with reference to the drawings.

Figure 1:
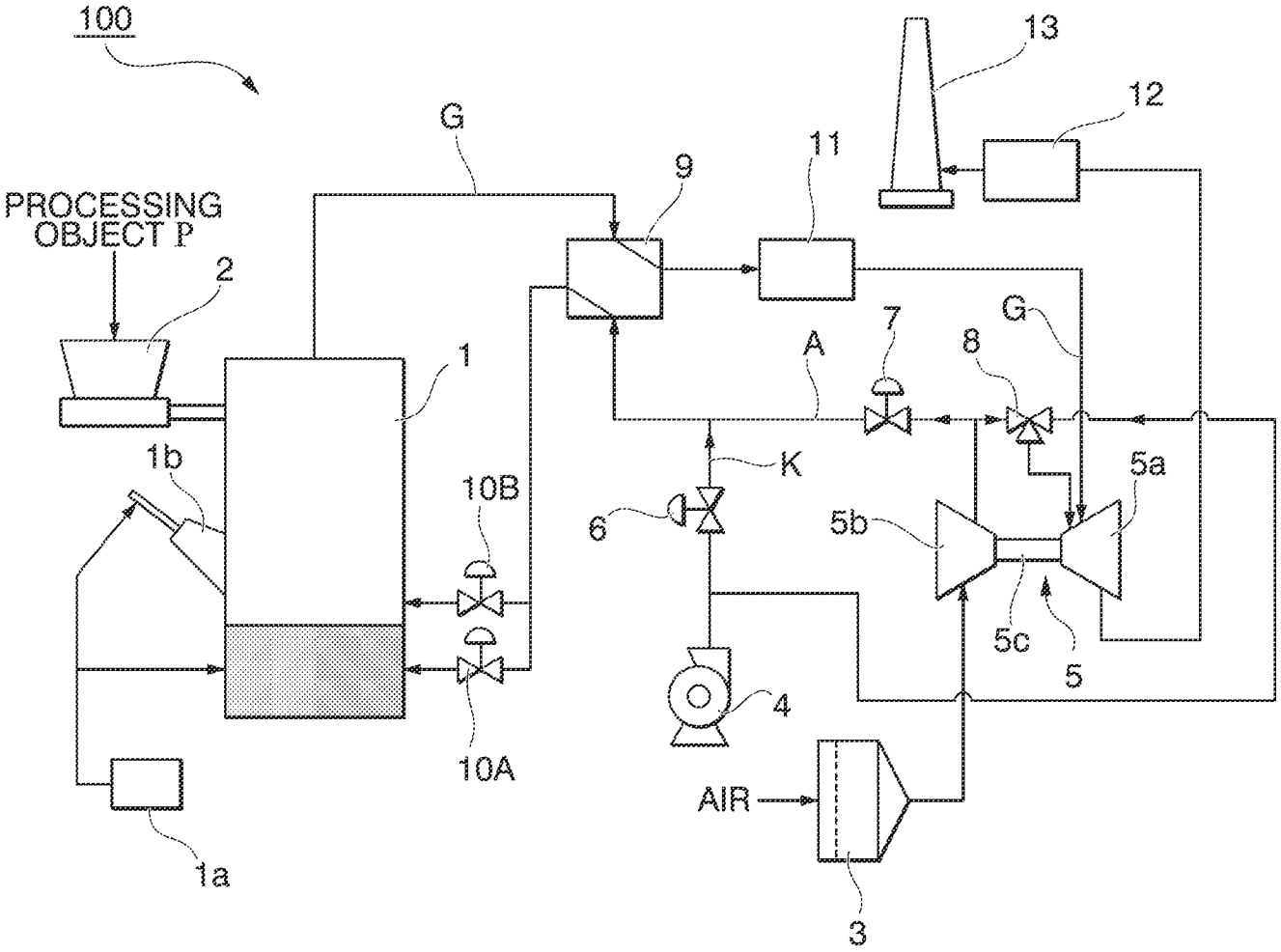
FIG. 1 is a system configuration diagram of a pressurized incineration facility of an embodiment of the present invention.

As shown in FIG. 1, a pressurized incineration facility 100 of this embodiment is configured including a pressurized-fluidized bed incinerator 1 (a pressurized incinerator), a supply device 2, an air filter 3, a blower 4, a turbocharger 5, a first on-off valve 6, a second on-off valve 7, a three-way valve 8 (a switching device), a preheater 9, first and second regulating valves 10A and 10B, a dust collector 11, an exhaust gas treatment device 12, a smokestack 13 and the like. As shown in FIG. 1, these components are connected to each other through pipes.

The pressurized-fluidized bed incinerator 1 is an approximately cylindrical incinerator. The pressurized-fluidized bed incinerator 1 obtains start-up air K supplied from the blower 4 through the first and second regulating valves 10A and 10B so that the start-up air K serves as primary combustion air and secondary combustion air or obtains compressed air A supplied from the turbocharger 5 through the first and second regulating valves 10A and 10B so that the compressed air A serves as the primary combustion air and the secondary combustion air, and thereby incinerates a processing object P in a pressurized-fluidized bed method. The pressurized-fluidized bed incinerator 1 exhausts high-temperature and high-pressure combustion exhaust gas G which is generated by incinerating the processing object P.

The pressurized-fluidized bed incinerator 1 is adjunctively provided with a start-up apparatus which increases the temperature inside the pressurized-fluidized bed incinerator 1 at the time the pressurized incineration facility 100 is started (at the time of start-up of the facility). The start-up apparatus is configured of an auxiliary fuel tank 1*a*, a heating burner 1*b* and the like. The start-up apparatus burns an auxiliary fuel together with the start-up air K inside the pressurized-fluidized bed incinerator 1, the auxiliary fuel having been supplied to the heating burner 1*b* from the auxiliary fuel tank 1*a* or from an auxiliary fuel supply source (not shown) of city gas or the like, and thereby increases the temperature inside the pressurized-fluidized bed incinerator 1 up to a predetermined temperature (for example, a temperature at which the processing object P spontaneously combusts).

The supply device 2 is a device which supplies the pressurized-fluidized bed incinerator 1 with the processing object P received from outside of the supply device 2, and is, for example, a screw conveyor or a pump. In addition, the processing object P being an incineration object of the pressurized-fluidized bed incinerator 1 is a combustible waste such as various kinds of biomass.

The air filter 3 is a device which purifies air by removing dirt, dust or the like therefrom, and supplies a compressor of the turbocharger 5 with purified air obtained by purifying air in this way.

The blower 4 is a device which operates only at the time of start-up of the facility similarly to the start-up apparatus of the pressurized-fluidized bed incinerator 1, and supplies the start-up air K to the pressurized-fluidized bed incinerator 1 at the time incineration of the processing object P is started by the pressurized-fluidized bed incinerator 1.

That is, since the pressurized-fluidized bed incinerator 1 is not in a normal combustion state at the time of start-up of the facility, the combustion exhaust gas G sufficient to drive the turbocharger 5 is not supplied to a turbine of the turbocharger 5 from the pressurized-fluidized bed incinerator 1. Therefore, the turbocharger 5 cannot compress air supplied from the air filter 3 (to be described later), and cannot supply the compressed air A to the pressurized-fluidized bed incinerator 1. The blower 4 in place of the turbocharger 5 at the time of start-up of the facility supplies the pressurized-fluidized bed incinerator 1 with the start-up air K obtained from outside air so that the start-up air K serves as the primary and secondary combustion air. The blower 4 stops operating at a phase (after start-up of the facility) in which the start-up of the pressurized incineration facility 100 finishes and the pressurized incineration facility 100 enters a normal operation state.

The turbocharger 5 compresses the purified air taken from the air filter 3 by being rotationally driven by the combustion exhaust gas G of the pressurized-fluidized bed incinerator 1, and thereby produces the compressed air A. The turbocharger 5 is a rotary machine in which a turbine impeller 5*a* and a compressor impeller 5*b* are fixed to a rotary shaft 5*c*. In the turbocharger 5, the compressor impeller 5*b* is rotationally driven by a rotational driving force generated by the combustion exhaust gas G, which serves as a drive fluid, striking on the turbine impeller 5*a*, and the compressed air A is produced by rotation of the compressor impeller 5*b*. The turbocharger 5 supplies the compressed air A to the second on-off valve 7.

Figure 2:
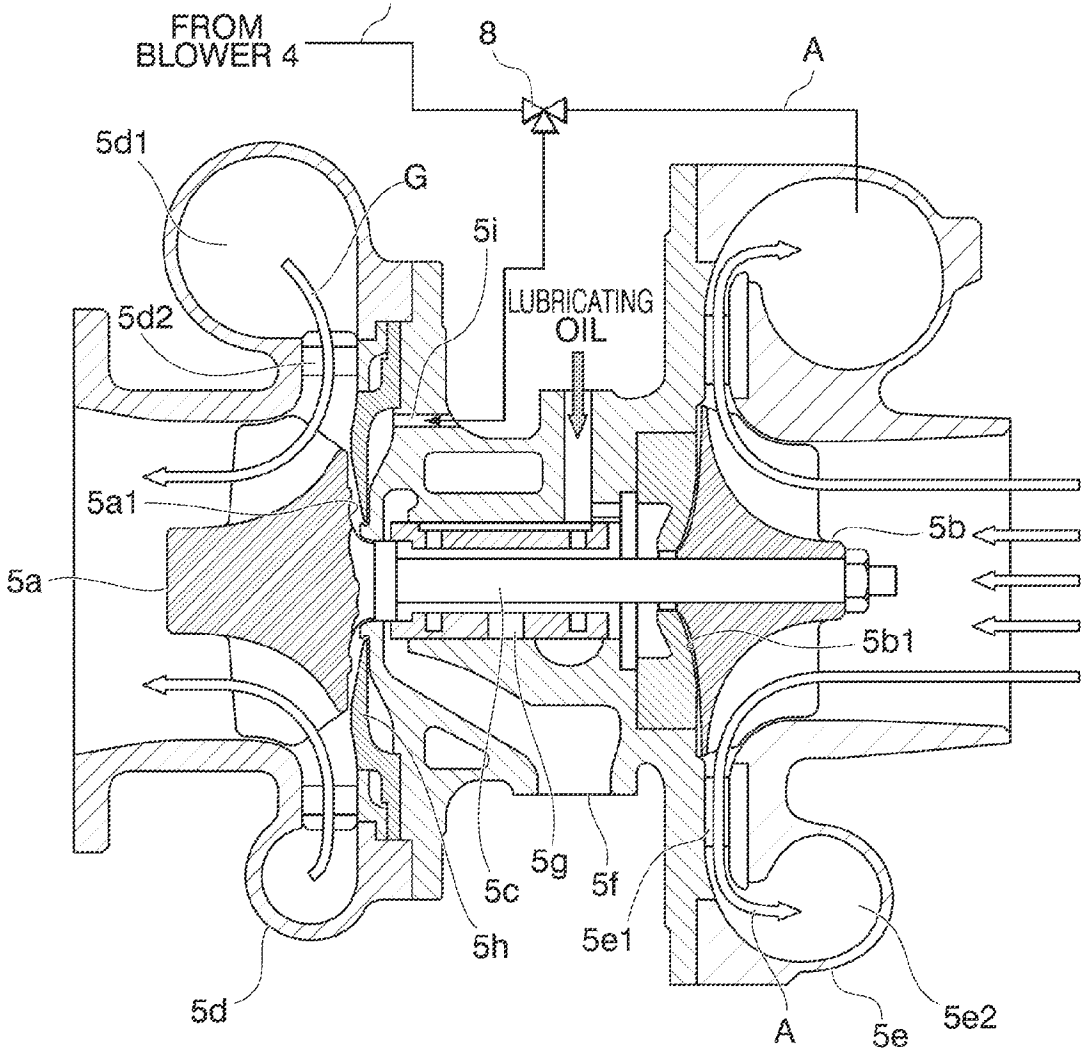
FIG. 2 is a cross-sectional diagram showing an overall structure of a turbocharger of the embodiment of the present invention.

In more detail, as shown in FIG. 2, the turbocharger 5 is configured so that a rotor, in which the turbine impeller 5*a* and the compressor impeller 5*b* are fixed and united to two ends of the rotary shaft 5*c*, is rotatably accommodated in a housing having a predetermined shape. A rear surface 5*a*1 of the turbine impeller 5*a* and a rear surface 5*b*1 of the compressor impeller 5*b* are disposed so as to face each other. In addition, for the sake of convenience, FIG. 2 shows a state where the turbocharger 5 shown in FIG. 1 is horizontally reversed, namely a state where the turbine impeller 5*a* is disposed on the left side of FIG. 2 and the compressor impeller 5*b* is disposed on the right side thereof.

As shown in FIG. 2, the housing of the turbocharger 5 is configured in which a turbine housing 5*d* accommodating the turbine impeller 5*a* and a compressor housing 5*e* accommodating the compressor impeller 5*b* are fixed using screws to a bearing housing 5*f* accommodating the rotary shaft 5*c* in a state where the bearing housing 5*f* is interposed between the turbine housing 5*d* and the compressor housing 5*e*. The bearing housing 5*f* also accommodates a bearing mechanism 5*g* in addition to the rotary shaft 5*c*, the bearing mechanism 5*g* rotatably supporting the rotary shaft 5*c*. An oil flow passageway which supplies lubricating oil to the bearing mechanism 5*g* is formed in the bearing housing 5*f*.

A heat shield plate 5*h*, which limits transfer of heat of the combustion exhaust gas G to the bearing mechanism 5*g*, is interposed between the turbine housing 5*d* and the bearing housing 5*f*.

The heat shield plate 5*h* is an approximately circular plate-shaped member provided with an opening at the center of the member, the rotary shaft 5*c* being inserted into the opening, and the outer peripheral part of the heat shield plate 5*h* is sandwiched between the turbine housing 5*d* and the bearing housing 5*f*.

A scroll flow passageway 5*d*1 and a turbine nozzle 5*d*2 are formed in the turbine housing 5*d* at a position radially outside of the turbine impeller 5*a*. In the turbine housing 5*d*, the combustion exhaust gas G passes through the scroll flow passageway 5*d*1 and the turbine nozzle 5*d*2, and strikes on the turbine impeller 5*a* from radially outside thereof, thereby generating a rotation force of the turbine impeller 5*a*.

A diffuser 5*e*1 and a scroll flow passageway 5*e*2 are formed in the compressor housing 5*e* at a position radially outside of the compressor impeller 5*b*. In the compressor housing 5*e*, the purified air supplied from the air filter 3 flows from the front side (the right side in FIG. 2) of the rotating compressor impeller 5*b* into the compressor impeller 5*b*, thereby being discharged into the diffuser 5*e*1, and thereafter passes through the diffuser 5*e*1 and the scroll flow passageway 5*e*2, thereby becoming the compressed air A.

Figure 3:
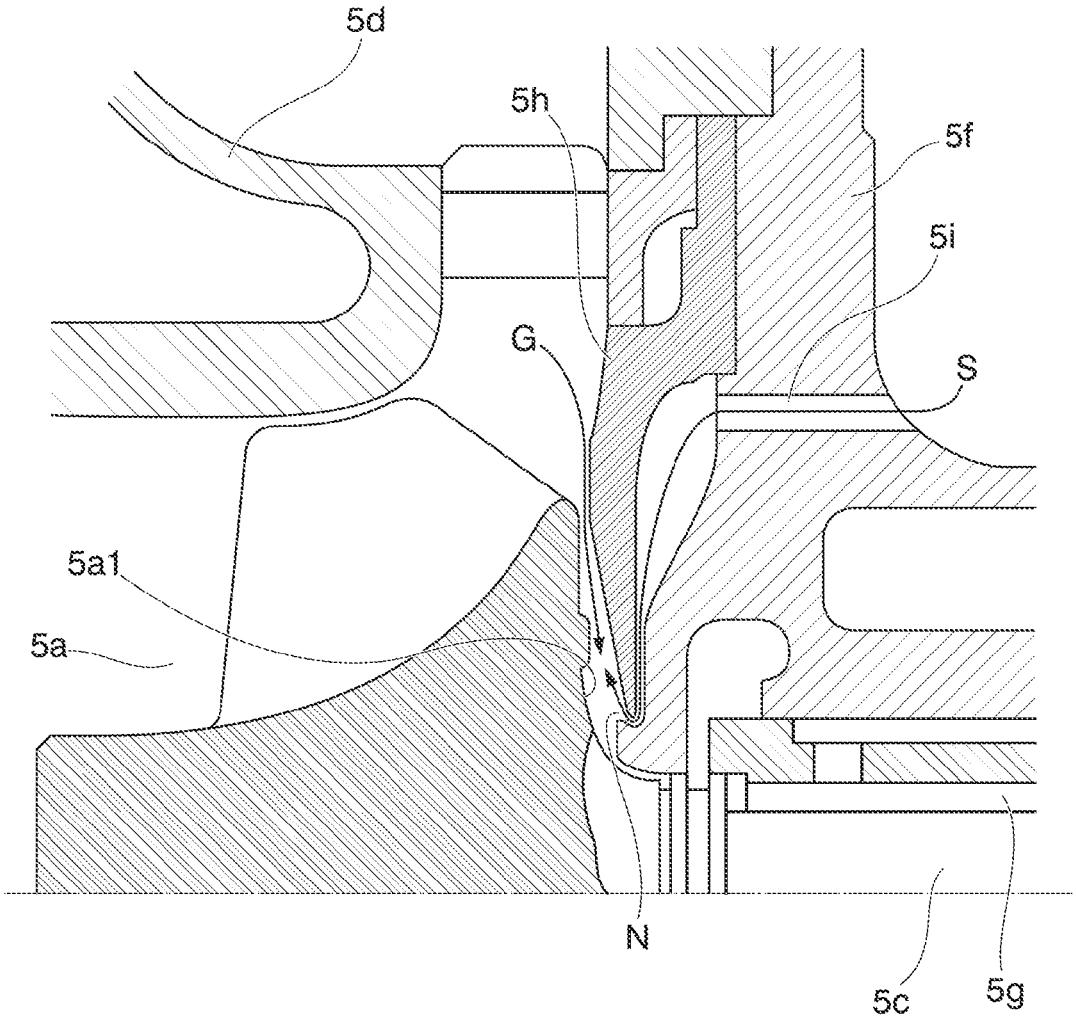
FIG. 3 is a cross-sectional diagram showing a main structure of the turbocharger of the embodiment of the present invention.

As shown in FIGS. 2 and 3, the turbocharger 5 is provided with a seal gas flow passageway 5*i* which supplies seal gas S to the rear surface 5*a*1 of the turbine impeller 5*a*. That is, the seal gas flow passageway 5*i* supplies the seal gas S into a space between the rear surface 5*a*1 of the turbine impeller 5*a* and the housing (the heat shield plate 5*h*) of the turbocharger 5. As shown in FIGS. 2 and 3, the seal gas flow passageway 5*i* is configured including a flow passageway, which is formed in the bearing housing 5*f* and in which one end thereof is connected to an output port (a discharge port) of the three-way valve 8, and a gap formed between the bearing housing 5*f* and the heat shield plate 5*h*. The other end (front end part) of the seal gas flow passageway 5*i* is a jetting port N for the seal gas S, the jetting port N being formed of a gap between the bearing housing 5*f* and the heat shield plate 5*h*.

The jetting port N opens at the housing facing the rear surface 5*a*1 of the turbine impeller 5*a*. That is, the other end of the seal gas flow passageway 5*i* is a small-width nozzle which opens in a circular-annular pattern around the rotary shaft 5*c*. The jetting port N is formed in a circular pattern coaxial with the turbine impeller 5*a*.

As shown in FIG. 3, a cross-sectional shape of the jetting port N along the central axis of the rotary shaft 5*c* is curved toward the outer periphery of the turbine impeller 5*a* so that the jetting port N jets the seal gas S to the rear surface 5*a*1 of the turbine impeller 5*a* toward the outer periphery of the turbine impeller 5*a*. The seal gas S jetted from the jetting port N to the rear surface 5*a*1 of the turbine impeller 5*a* toward the outer periphery thereof forms a continuous gas film around the rotary shaft 5*c* on the rear surface 5*a*1 of the turbine impeller 5*a*. Thus, the seal gas S can limit or prevent inflow of the combustion exhaust gas G into the bearing mechanism 5*g* supporting the rotary shaft 5*c*, the combustion exhaust gas G having flowed to the rear surface 5*a*1 of the turbine impeller 5*a*.

It is to be noted that since the inflow of the combustion exhaust gas G into the bearing mechanism 5*g* is prevented by a continuous gas film formed at least around the rotary shaft 5*c*, the seal gas S need not be jetted toward the outer periphery of the turbine impeller 5*a*. For example, the seal gas S may be jetted to the rear surface 5*a*1 of the turbine impeller 5*a* in a direction approximately perpendicular to the rear surface 5*a*1. In some cases, the seal gas S may be jetted inward slightly (toward the rotation center) of the turbine impeller 5*a*.

In order to form a gas film capable of stably countering the inflow of the combustion exhaust gas G, it is preferable that the facing distance (for example, the distance in the central axis direction of the rotary shaft 5*c*) between the jetting port N and the rear surface 5*a*1 of the turbine impeller 5*a* be as small as possible. For example, the shapes of the bearing housing 5*f* and the heat shield plate 5*h* may be changed so that the facing distance is decreased. Because of intervention of the three-way valve 8, the seal gas flow passageway 5*i* is supplied with part of the start-up air K at the time of start-up of the facility so that the start-up air K serves as the seal gas S, and on the other hand, is supplied with part of the compressed air A after start-up of the facility so that the compressed air A serves as the seal gas S.

As shown in FIG. 1, the first on-off valve 6 is provided in a discharge-side pipe of the blower 4. The first on-off valve 6 is set to be completely opened at the time of start-up of the facility, and on the other hand, is set to be completely closed after start-up of the facility.

As shown in FIG. 1, the second on-off valve 7 is provided in a pipe connected to an outlet of the compressor of the turbocharger 5, namely in the pipe connected to an outlet of the scroll flow passageway 5*e*2. The second on-off valve 7 is set to be completely closed at the time of start-up of the facility, and on the other hand, is set to be completely opened after start-up of the facility. That is, at the time of start-up of the facility, only the start-up air K discharged from the blower 4 is supplied to the preheater 9 through pipes.

The three-way valve 8 is a switching device including two input ports and one output port, and selects one from the two input ports and connects one to the output port. As shown in FIGS. 1 and 2, in the three-way valve 8, one input port is connected to the blower 4, and the other input port is connected to the outlet (namely, the outlet of the scroll flow passageway 5*e*2) of the compressor of the turbocharger 5. In addition, the output port of the three-way valve 8 is connected to one end (the rear end) of the seal gas flow passageway 5*i*. At the time of start-up of the facility, the three-way valve 8 selects the one input port and thereby supplies the seal gas flow passageway 5*i* with the start-up air K supplied from the blower 4. On the other hand, after start-up of the facility, the three-way valve 8 selects the other input port and thereby supplies the seal gas flow passageway 5*i* with the compressed air A supplied from the turbocharger 5.

In the pressurized incineration facility 100, the three-way valve 8 and the seal gas flow passageway 5*i* of the turbocharger 5 constitute a seal device which obtains the start-up air K or the compressed air A and which jets out the air to the rear surface 5*a*1 of the turbine impeller 5*a* so that the air serves as the seal gas S. In addition, the blower 4 and the turbocharger 5 also serve as a gas supply source in the pressurized incineration facility 100.

The preheater 9 is provided between the first and second on-off valves 6 and 7 and the first and second regulating valves 10A and 10B. The preheater 9 is a heat exchanger which increases the temperature of the start-up air K supplied from the blower 4 (at the time of start-up of the facility) or of the compressed air A supplied from the turbocharger 5 (after start-up of the facility) by using the combustion exhaust gas G supplied from the pressurized-fluidized bed incinerator 1. The temperature of the compressed air A is increased by compression operation of the compressor impeller 5*b* so as to be higher than the temperature (approximately equal to the atmospheric temperature) of the purified air. The preheater 9 further increases the temperature of the start-up air K or of the compressed air A by exchanging heat between the high-temperature combustion exhaust gas G and the start-up air K or the compressed air A, and thereafter supplies the start-up air K or the compressed air A to the first and second regulating valves 10A and 10B. In addition, the preheater 9 discharges into the dust collector 11, the combustion exhaust gas G whose temperature has been decreased through heat exchange with the start-up air K or with the compressed air A.

The first regulating valve 10A is a first control valve which regulates the flow volume of the compressed air A (or the start-up air K) to be supplied to the bottom of the pressurized-fluidized bed incinerator 1 so that the air serves as the primary combustion air. On the other hand, the second regulating valve 10B is a second control valve which regulates the flow volume of the compressed air A (or the start-up air K) to be supplied to a position of the pressurized-fluidized bed incinerator 1 so that the air serves as the secondary combustion air, the position being higher in the vertical direction than a position to which the primary combustion air is supplied. The first and second regulating valves 10A and 10B are regulated so that the combustion state of the processing object P inside the pressurized-fluidized bed incinerator 1 becomes most preferable.

The dust collector 11 is a device which separates and removes solids such as dust from the combustion exhaust gas G supplied from the preheater 9, and is, for example, a bug filter. The dust collector 11 supplies the turbine of the turbocharger 5 with the high-temperature combustion exhaust gas G from which the solids have been separated and removed. The combustion exhaust gas G acts on the turbine impeller 5*a*, whereby the pressure and temperature of the combustion exhaust gas G are decreased, and thereafter the combustion exhaust gas G is supplied to the exhaust gas treatment device 12.

The exhaust gas treatment device 12 is a device which removes impurities such as sulfur component or nitrogen component from the combustion exhaust gas G supplied from the dust collector 11, and supplies the smokestack 13 with exhaust gas purified by removing the impurities. The smokestack 13 is a well-known cylindrical construct having a predetermined height, and releases exhaust gas into the atmosphere from a predetermined height, the exhaust gas being supplied from the exhaust gas treatment device 12.

Next, the operation of the pressurized incineration facility 100, particularly the operation of the seal device being a distinctive component in the pressurized incineration facility 100, is described in detail.

First, the operation of the pressurized incineration facility 100 at the time of start-up (at the time of start-up of the facility) is described. At the time of start-up of the facility, the first on-off valve 6 is set to be completely opened, the second on-off valve 7 is set to be completely closed, and the three-way valve 8 being the switching device is set so as to select the one input port thereof. The blower 4 operates in this state, whereby most of the start-up air K discharged from the blower 4 is supplied to the pressurized-fluidized bed incinerator 1, and part of the start-up air K is supplied to the seal gas flow passageway 5*i* of the turbocharger 5 through the three-way valve 8.

That is, the start-up air K discharged from the blower 4 is supplied to the first and second regulating valves 10A and 10B via the first on-off valve 6 and the preheater 9, the flow volume of the start-up air K is finally regulated by the first and second regulating valves 10A and 10B, and thereafter the start-up air K is supplied to the pressurized-fluidized bed incinerator 1 and to the heating burner 1*b*. The pressurized-fluidized bed incinerator 1 takes the start-up air K therein so that the start-up air K serves as the first and second combustion air, and the start-up apparatus burns fuel (auxiliary fuel) by using the first and second combustion air serving as an oxidizer, thereby gradually increasing the temperature inside the incinerator.

When the temperature inside the pressurized-fluidized bed incinerator 1 is increased up to a predetermined temperature (for example, a temperature at which the processing object P spontaneously combusts), the supply device 2 operates and supplies the processing object P thereinto, and thereby the pressurized-fluidized bed incinerator 1 starts an incineration process (combustion process) of the processing object P. When the incineration process of the processing object P is started, the combustion exhaust gas G of a volume sufficient to drive the turbocharger 5 is generated inside the pressurized-fluidized bed incinerator 1. The combustion exhaust gas G is supplied from the pressurized-fluidized bed incinerator 1 to the turbine of the turbocharger 5 via the preheater 9 and the dust collector 11. As a result, the turbocharger 5 is rotationally driven by the combustion exhaust gas G supplied from the pressurized-fluidized bed incinerator 1.

When the turbocharger 5 reaches a state of being rotationally driven by the combustion exhaust gas G in this way, the operation of the blower 4 is stopped, the first on-off valve 6 is set to be completely closed, the second on-off valve 7 is set to be completely opened, and the three-way valve 8 is set so as to select the other input port thereof. As a result, the pressurized incineration facility 100 changes from a facility start-up state (the time of start-up of the facility) to a normal operation state (after start-up of the facility).

After start-up of the facility, the combustion exhaust gas G, from which solids have been separated and removed at the dust collector 11, is supplied to the turbocharger 5, and the compressed air A supplied from the turbocharger 5 is preheated by the preheater 9. The combustion exhaust gas G which has been used for driving the turbocharger 5 is supplied from the turbocharger 5 to the exhaust gas treatment device 12, impurities of the combustion exhaust gas G are removed, and thereafter the exhaust gas is released from the smokestack 13 into the atmosphere. In addition, the compressed air A, which has been preheated by the preheater 9 and thereafter whose flow volume has been regulated by the first and second regulating valves 10A and 10B, is supplied to the pressurized-fluidized bed incinerator 1, and is used for combustion of the processing object P so that the compressed air A serves as the first and second combustion air.

The above description shows the overall operation of the pressurized incineration facility 100, and the pressurized incineration facility 100 performs distinctive operations described below at the time of start-up of the facility and after start-up of the facility.

That is, at the time of start-up of the facility, part of the start-up air K is supplied to the seal gas flow passageway 5*i* of the turbocharger 5 through the three-way valve 8, and is jetted to the rear surface 5*a*1 of the turbine impeller 5*a* toward the outer periphery of the turbine impeller 5*a* from the jetting port N positioned at the front end of the seal gas flow passageway 5*i* so that the start-up air K serves as the seal gas S. Thus, part of the start-up air K is supplied into a space between the rear surface 5*a*1 of the turbine impeller 5*a* and the housing (the heat shield plate 5*h*) of the turbocharger 5 so that the start-up air K serves as the seal gas S. The seal gas S (the start-up air K) forms a continuous gas film around the rotary shaft 5*c* on the rear surface 5*a*1 of the turbine impeller 5*a*.

Since the second on-off valve 7 is set to be completely closed at the time of start-up of the facility, part of the start-up air K discharged from the blower 4 is prevented from being supplied to the outlet of the compressor of the turbocharger 5 and from giving disturbance to the compressor of the turbocharger 5. In addition, since the three-way valve 8 is set so as to select the one input port at the time of start-up of the facility, the seal gas flow passageway 5*i* is not supplied with discharged air of the compressor of the turbocharger 5 having an insufficient pressure because the rotation speed of the turbocharger 5 does not reach a normal rotation speed but is supplied with the start-up air K provided with a predetermined flow velocity by the blower 4.

As a result, the combustion exhaust gas G which has flowed to the rear surface 5*a*1 of the turbine impeller 5*a* cannot flow into the vicinity of the rotary shaft 5*c* due to the gas film formed by the seal gas S (the start-up air K), and thus cannot flow into the bearing mechanism 5*g* supporting the rotary shaft 5*c* inside the bearing housing 5*f*. Therefore, since the combustion exhaust gas G can be prevented from contacting the lubricating oil of the bearing mechanism 5*g*, deterioration of the lubricating oil can be prevented at the time of start-up of the facility.

On the other hand, after start-up of the facility, the seal gas flow passageway 5*i* is supplied through the three-way valve 8 with part of the compressed air A discharged from the compressor of the turbocharger 5 instead of part of the start-up air K discharged from the blower 4. The compressed air A has a sufficient pressure because the compressed air A is gas discharged from the compressor of the turbocharger 5 which normally rotates. The compressed air A is jetted from the jetting port N to the rear surface 5*a*1 of the turbine impeller 5*a* toward the outer periphery of the turbine impeller 5*a* so that the compressed air A serves as the seal gas S. That is, part of the compressed air A is supplied into a space between the rear surface 5*a*1 of the turbine impeller 5*a* and the housing (the heat shield plate 5*h*) of the turbocharger 5 so that the compressed air A serves as the seal gas S. The seal gas S (the compressed air A) forms a continuous gas film around the rotary shaft 5*c* on the rear surface 5*a*1 of the turbine impeller 5*a*.

As a result, the combustion exhaust gas G which has flowed to the rear surface 5*a*1 of the turbine impeller 5*a* cannot flow into the vicinity of the rotary shaft 5*c* due to the gas film formed by the seal gas S (the compressed air A), and thus cannot flow into the bearing mechanism 5*g* supporting the rotary shaft 5*c* inside the bearing housing 5*f*. Therefore, since contact of the combustion exhaust gas G with the lubricating oil of the bearing mechanism 5*g* can be prevented by the seal gas S (the compressed air A), deterioration of the lubricating oil can also be prevented after start-up of the facility.

The pressure of the start-up air K used as the seal gas S at the time of start-up of the facility may be lower than that of the compressed air A at the time of the normal operation of the turbocharger 5. However, the pressure of the combustion exhaust gas G at the time of start-up of the facility is lower than the pressure of the combustion exhaust gas G at the time of the normal operation. That is, the jetting pressure required of the seal gas S at the time of start-up of the facility is lower than the jetting pressure required of the seal gas S at the time of the normal operation. Therefore, if the start-up air K is jetted to the rear surface 5*a*1 of the turbine impeller 5*a* at the time of start-up of the facility so that the start-up air K serves as the seal gas S, the combustion exhaust gas G can be sufficiently prevented from flowing into the bearing mechanism 5*g*.

As described above, in this embodiment, the start-up air K is used as the seal gas S at the time of start-up of the facility, and the compressed air A is used as the seal gas S after start-up of the facility. That is, in this embodiment, at the time of start-up of the facility, inflow of the combustion exhaust gas G into the bearing mechanism 5*g* is prevented by using the blower 4 as the supply source of the seal gas S, and after start-up of the facility, inflow of the combustion exhaust gas G into the bearing mechanism 5*g* is prevented by using the turbocharger 5 as the supply source of the seal gas S. According to this embodiment, inflow of the combustion exhaust gas G into the bearing mechanism 5*g* can be prevented in both cases at the time of start-up of the facility and after start-up of the facility, and thereby deterioration of the lubricating oil can be limited.

Hereinbefore, the preferable embodiment of the present invention is described with reference to the attached drawings, but the present invention is not limited to this embodiment. The shape, the combination or the like of each component shown in the above embodiment is merely an example, and additions, omissions, replacements, and other modifications of configurations based on design requests or the like can be adopted within the scope of and not departing from the gist of the present invention. For example, the following modifications can be proposed.

(1) In the above embodiment, the start-up air K is used as the seal gas S at the time of start-up of the facility, and the compressed air A is used as the seal gas S after start-up of the facility (during the normal operation), but the present invention is not limited thereto. For example, in a case where a separately prepared air supply source (for example, a compressor) is used, the air supply source may be used at the time of start-up instead of a start-up blower, and may be switched to a turbocharger after start-up so that the turbocharger supplies air serving as seal gas. In addition, at the time of start-up, a start-up blower may supply air serving as seal gas, and after start-up, may be switched to a separately prepared air supply source. Furthermore, a separately prepared air supply source may be used in both cases at the time of start-up and after start-up.

(2) In the above embodiment, the seal gas S is not only jetted to the rear surface 5*a*1 of the turbine impeller 5*a* at the time after start-up in which the pressurized incineration facility is in the normal operation state but is also jetted thereto at the time of start-up of the facility, but the present invention is not limited thereto. Since the amount of the combustion exhaust gas G generated at the time of start-up of the facility is small and the pressure thereof is low, the combustion exhaust gas G has a low potential to flow into the bearing mechanism 5*g*. In view of this point, it is conceivable that jetting of the seal gas S is not performed at the time of start-up of the facility. In this case, since it is only necessary to supply the compressed air A to the seal gas flow passageway 5*i* after start-up of the facility, the three-way valve 8 may be omitted, and discharged air of the compressor of the turbocharger 5 may be directly supplied to the seal gas flow passageway 5*i*. That is, the seal device in this case includes as a main component, the turbocharger 5 including the seal gas flow passageway 5*i*.

(3) In the above embodiment, only one annular jetting port N is provided facing the rear surface 5*a*1 of the turbine impeller 5*a*, but the present invention is not limited thereto. For example, as shown in FIGS. 4A and 4B, the heat shield plate 5*h* may be composed of three unit plates 5*h*1, 5*h*2 and 5*h*3, and thereby three flow passageways (branching flow passageways) 5*i*1, 5*i*2 and 5*i*3 may be provided so that the jetting ports of the three flow passageways face the rear surface 5*a*1 of the turbine impeller 5*a*.

Figure 4A:
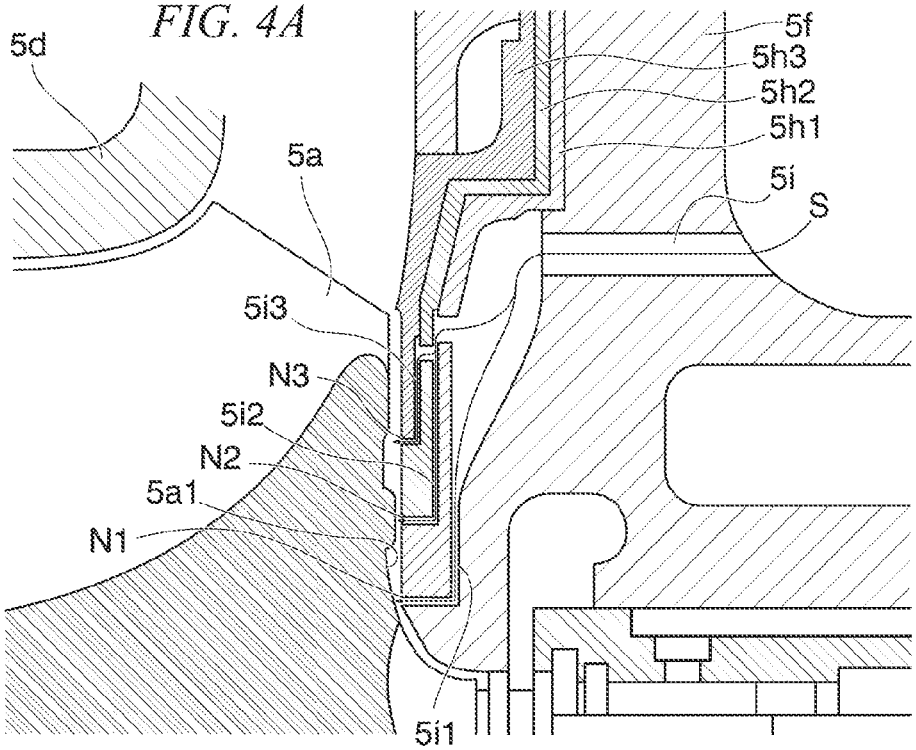
FIG. 4A is a cross-sectional diagram showing a first modification of the main structure of the turbocharger of the embodiment of the present invention.

That is, as shown in FIG. 4A, a first flow passageway 5*i*1 which supplies the seal gas S to the rear surface 5*a*1 of the turbine impeller 5*a* is formed by the bearing housing 5*f* and the first unit plate 5*h*1, a second flow passageway (branching flow passageway) 5*i*2 communicating with the first flow passageway 5*i*1 is formed by the first and second unit plates 5*h*1 and 5*h*2, and a third flow passageway (branching flow passageway) 5*i*3 communicating with the second flow passageway 5*i*2 is formed by the second and third unit plates 5*h*2 and 5*h*3. The front end parts of the first to third flow passageways 5*i*1 to 5*i*3 are small-width jetting ports N1 to N3 (nozzles) provided in a triple annular pattern around the rotary shaft 5*c*. Each of the jetting ports N1 to N3 is disposed in a circular pattern coaxial with the turbine impeller 5*a*.

Figure 4B:
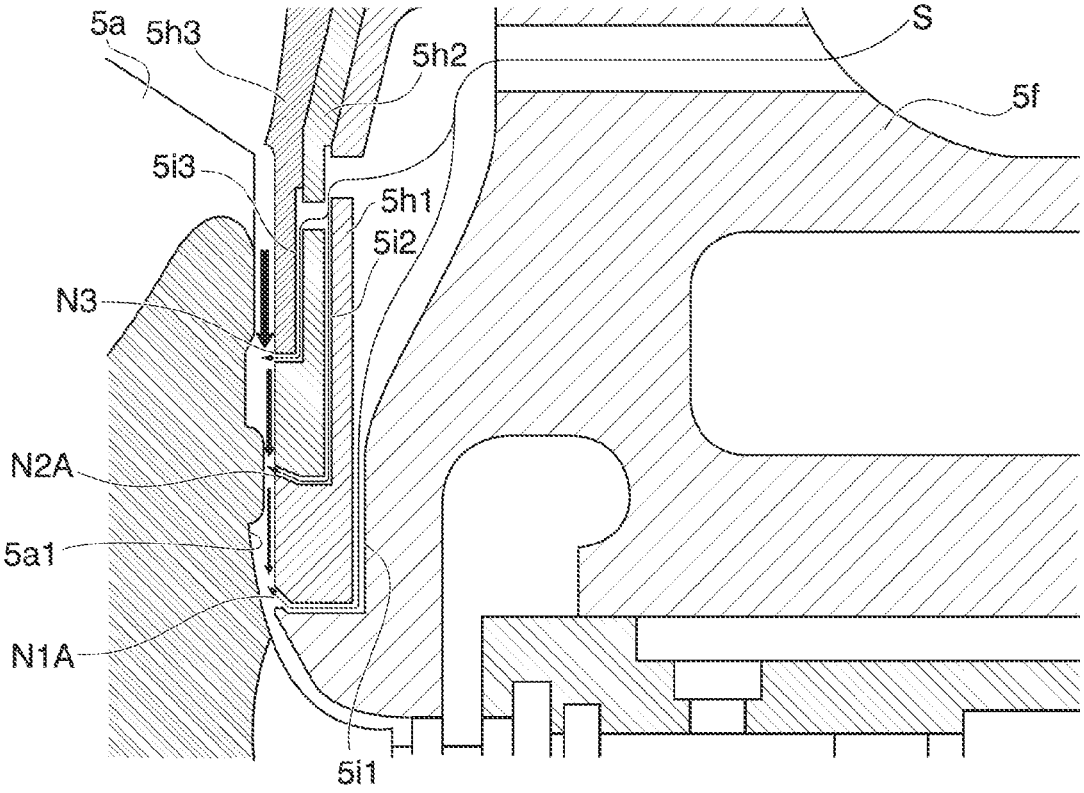
FIG. 4B is a cross-sectional diagram showing a modification of FIG. 4A.

As shown in FIGS. 4A and 4B, the first flow passageway 5*i*1 is formed of a gap between the bearing housing 5*f* and the first unit plate 5*h*1. The second flow passageway 5*i*2 is formed of a through-hole formed in the first unit plate 5*h*1 and of a gap between the first and second unit plates 5*h*1 and 5*h*2. The third flow passageway 5*i*3 is formed of a through-hole formed in the second unit plate 5*h*2 and of a gap between the second and third unit plates 5*h*2 and 5*h*3. Since a triple gas seal is formed around the rotary shaft 5*c* by providing the three jetting ports N1 to N3, it is possible to further reliably prevent the combustion exhaust gas G from flowing into the bearing mechanism 5*g* and from affecting the lubricating oil.

FIG. 4A shows a state where the three jetting ports N1 to N3 are formed so that all the three jetting ports N1 to N3 jet the seal gas S to the rear surface 5*a*1 of the turbine impeller 5*a* in a direction approximately perpendicular to the rear surface 5*a*1. However, for example, as shown in FIG. 4B, two jetting ports N1A and N2A close to the rotary shaft 5*c* may be formed so as to jet the seal gas S toward the outer periphery of the turbine impeller 5*a*.

Figure 5:
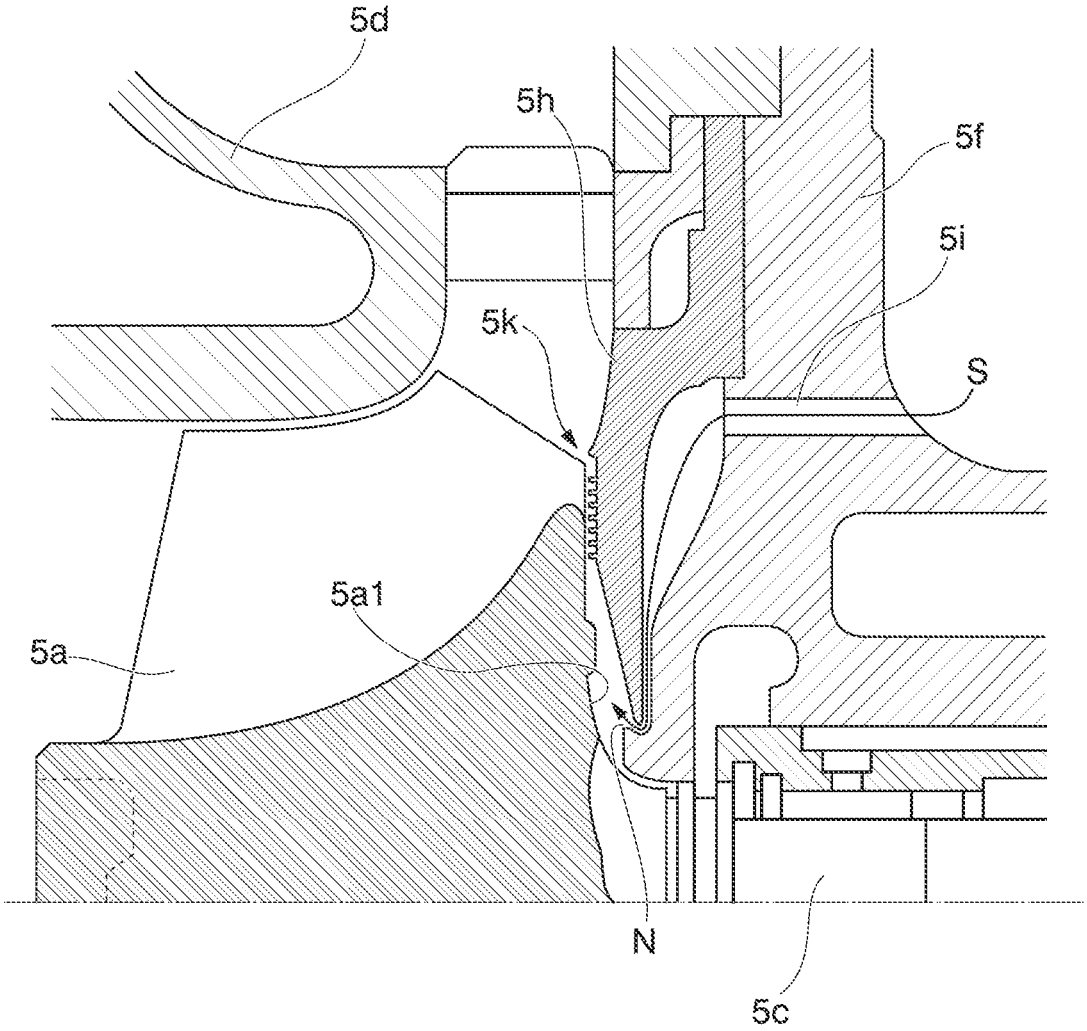
FIG. 5 is a cross-sectional diagram showing a second modification of the main structure of the turbocharger of the embodiment of the present invention.

(4) In the above embodiment, only one annular jetting port N is provided facing the rear surface 5*a*1 of the turbine impeller 5*a*, but the present invention is not limited thereto. For example, as shown in FIG. 5, a labyrinth seal 5*k* is added to part of the heat shield plate 5*h* closest to the turbine impeller 5*a*, and thereby the labyrinth seal 5*k* and the gas seal formed by the seal gas S can further reliably prevent the combustion exhaust gas G from flowing into the bearing mechanism 5*g* and from affecting the lubricating oil.

Figure 6:
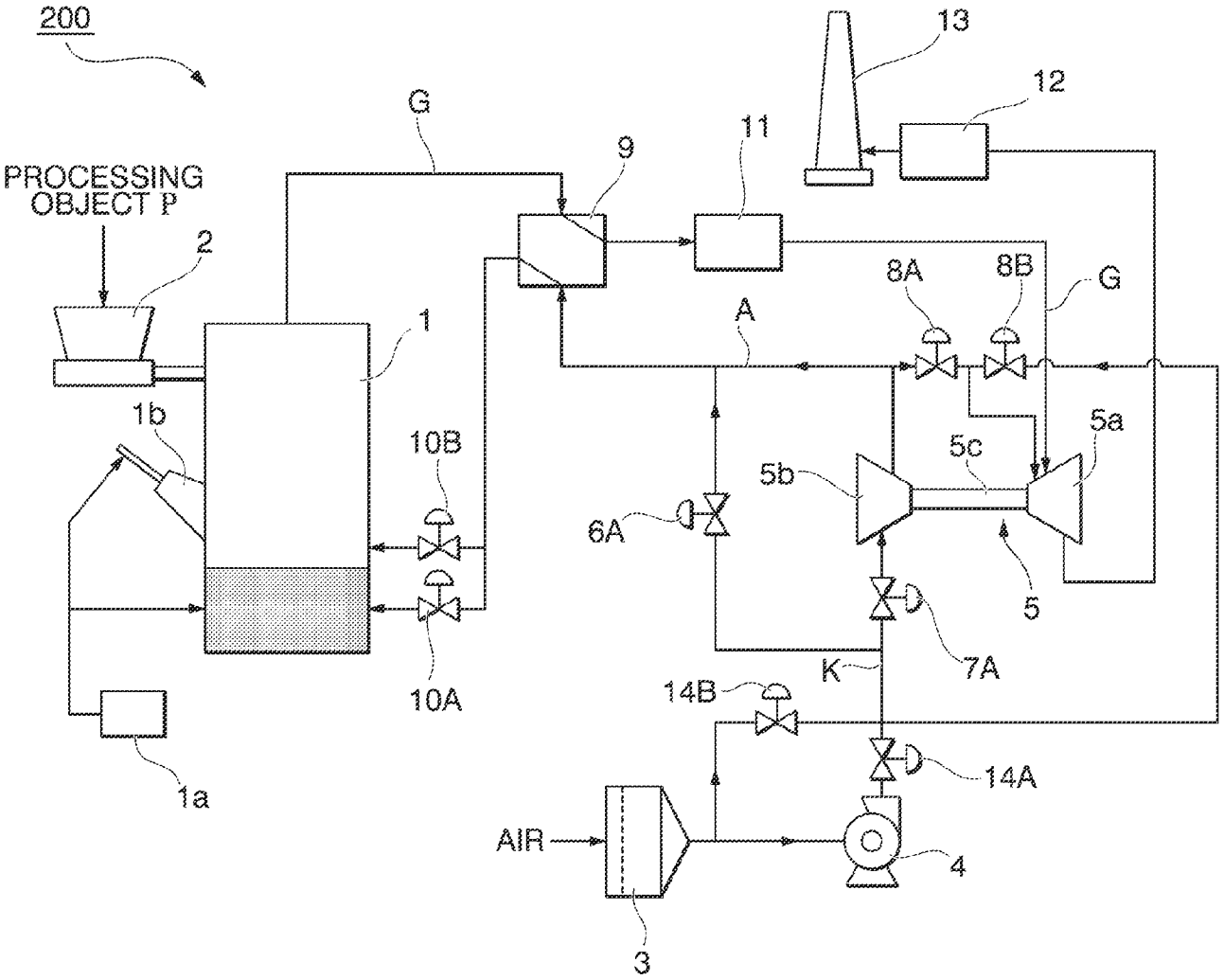
FIG. 6 is a system configuration diagram showing a modification of the pressurized incineration facility of the embodiment of the present invention.

(5) In the above embodiment, the outlet of the blower 4 is connected to the outlet of the compressor of the turbocharger 5, but the present invention is not limited thereto. For example, a configuration shown in FIG. 6 may be adopted in which the blower 4 is interposed between the inlet of the compressor of the turbocharger 5 and the air filter 3, a second on-off valve 7A and a third on-off valve 14A are provided between the outlet of the blower 4 and the inlet of the compressor of the turbocharger 5, a bypass pipe connects the inlet and the outlet of the compressor of the turbocharger 5, and the bypass pipe is provided with a first on-off valve 6A. Additionally, in FIG. 6, a second bypass pipe connects the air filter 3 and the turbocharger 5 so as to bypass the blower 4, the second bypass pipe is provided with a fourth on-off valve 14B, and a fifth on-off valve 8A and a sixth on-off valve 8B are adopted instead of the three-way valve 8.

In a pressurized incineration facility 200 having the above configuration, at the time of start-up of the facility, the first and third on-off valves 6A and 14A are completely opened, the second and fourth on-off valves 7A and 14B are completely closed, and furthermore the fifth on-off valve 8A is completely closed, and the sixth on-off valve 8B is completely opened. The blower 4 operates in this state, whereby most of the start-up air K discharged from the blower 4 is supplied to the pressurized-fluidized bed incinerator 1 through the first on-off valve 6A, and part of the start-up air K is supplied to the seal gas flow passageway 5*i* of the turbocharger 5 through the sixth on-off valve 8B. The start-up air K is jetted to the rear surface 5*a*1 of the turbine impeller 5*a* through the seal gas flow passageway 5*i* so that the start-up air K serves as the seal gas S, and prevents the combustion exhaust gas G from flowing into the bearing mechanism 5*g*.

On the other hand, after start-up of the facility, the blower 4 stops operating, the first and third on-off valves 6A and 14A are completely closed, the second and fourth on-off valves 7A and 14B are completely opened, and furthermore the fifth on-off valve 8A is completely opened, and the sixth on-off valve 8B is completely closed. As a result, the turbocharger 5 rotationally driven by the combustion exhaust gas G produces the compressed air A by inhaling purified air supplied from the air filter 3 without intervention of the blower 4, and supplies the compressed air A to the pressurized-fluidized bed incinerator 1. In addition, part of the compressed air A is supplied to the seal gas flow passageway 5*i* of the turbocharger 5 through the fifth on-off valve 8A, and is jetted to the rear surface 5*a*1 of the turbine impeller 5*a* through the seal gas flow passageway 5*i* so that the compressed air A serves as the seal gas S, thereby preventing the combustion exhaust gas G from flowing into the bearing mechanism 5*g*.

In the pressurized incineration facility 200, similarly to the above embodiment, since the start-up air K or the compressed air A is also jetted to the rear surface 5*a*1 of the turbine impeller 5*a* so as to serve as the seal gas S, inflow of the combustion exhaust gas G into the bearing mechanism 5*g* can be prevented, and thus deterioration of the lubricating oil can be limited.

Additionally, in the pressurized incineration facility 100 of the above embodiment, the fifth and sixth on-off valves 8A and 8B of the pressurized incineration facility 200 may be adopted instead of the three-way valve 8. That is, the fifth and sixth on-off valves 8A and 8B may be used as the switching device of the present invention.

(6) In the above embodiment, the pressurized-fluidized bed incinerator 1 is used, but the pressurized incinerator of the present invention is not limited to an incinerator having a fluidized bed, and another type of pressurized incinerator may be adopted.

(7) As described above, although the discharge amount of the combustion exhaust gas G discharged from the pressurized-fluidized bed incinerator 1 at the time of start-up of the facility is generally less than the discharge amount thereof at the time of the normal operation, the discharge amount of the combustion exhaust gas G discharged from the pressurized-fluidized bed incinerator 1 at the time of the normal operation may also vary in accordance with the processing amount of the processing object P, or the like. It is considered that the flow volume of the compressed air A discharged from the turbocharger 5, namely the flow volume of the seal gas S, varies in proportion to the flow volume of the combustion exhaust gas G supplied to the turbocharger 5, and it may be preferable that the flow volume of the jetted seal gas S be regulated in order that the seal gas S does not influence the turbine efficiency of the turbocharger 5. In this case, a flow volume-regulating device (regulating valve) may be provided at a position of a flow passageway from the three-way valve 8 to the jetting port N. In addition, a controller or the like may be provided which controls the flow volume-regulating device based on information of the processing amount of the pressurized-fluidized bed incinerator 1, the discharge amount of the combustion exhaust gas G the rotation speed of the turbocharger 5, or the like.

INDUSTRIAL APPLICABILITY

The present invention can be applied to a pressurized incineration facility and a pressurized incineration method used to incinerate a processing object under a pressure increased by compressed air.

DESCRIPTION OF REFERENCE SIGNS

1 pressurized-fluidized bed incinerator (pressurized incinerator)
2 supply device
3 air filter
4 blower
5 turbocharger
5*a* turbine impeller
5*a*1 rear surface
5*b* compressor impeller
5*c* rotary shaft
5*d* turbine housing
5*e* compressor housing
5*f* bearing housing
5*g* bearing mechanism
5*h* heat shield plate
5*i* seal gas flow passageway (seal device)
6 first on-off valve
7 second on-off valve
8 three-way valve (switching device)
8A fifth on-off valve
8B sixth on-off valve
9 preheater
10A first regulating valve
10B second regulating valve
11 dust collector
12 exhaust gas treatment device
13 smokestack
14A third on-off valve
14B fourth on-off valve
100, 200 pressurized incineration facility
A compressed air
G combustion exhaust gas
K start-up air
P processing object
S seal gas
N jetting port

The invention claimed is:

1. A pressurized incineration facility comprising:
a pressurized incinerator which incinerates a processing object under a pressure increased by compressed air;
a turbocharger which produces the compressed air by being rotationally driven by combustion exhaust gas from the pressurized incinerator; and
a seal device which jets seal gas to a rear surface of a turbine impeller of the turbocharger,
wherein the turbocharger comprises:
a turbine housing accommodating the turbine impeller;
a bearing housing rotatably supporting a rotary shaft fixed to the turbine impeller;
and
a circular heat shield plate disposed between the turbine housing and the bearing housing and provided with an opening into which the rotary shaft is inserted, and
wherein a jetting port of the seal device configured to jet the seal gas to the rear surface of the turbine impeller is formed between the bearing housing and an edge of the opening of the heat shield plate.

2. The pressurized incineration facility according to claim 1, further comprising:
a blower which supplies start-up air to the pressurized incinerator at the time of start-up of the facility,
wherein the seal device is configured to obtain the start-up air of the blower at the time of start-up of the facility and to jet the start-up air to the rear surface of the turbine impeller so that the start-up air serves as the seal gas, and is configured to obtain the compressed air of the turbocharger after start-up of the facility and to jet the compressed air to the rear surface of the turbine impeller so that the compressed air serves as the seal gas.

3. The pressurized incineration facility according to claim 2,
wherein the seal device includes:
a switching device which selects and discharges the start-up air at the time of start-up of the facility, and which selects and discharges the compressed air after start-up of the facility; and
a seal gas flow passageway provided in the turbocharger, one end of the seal gas flow passageway being connected to a discharge port of the switching device, and another end of the seal gas flow passageway opening at a housing facing the rear surface of the turbine impeller.

4. The pressurized incineration facility according to claim 1, wherein the seal device includes a seal gas flow passageway which is provided in the turbocharger and which guides the compressed air to a housing facing the rear surface of the turbine impeller so that the compressed air serves as the seal gas.

5. The pressurized incineration facility according to claim 1, wherein the seal device includes a plurality of jetting ports which jet the seal gas to a plurality of parts of the rear surface of the turbine impeller.

6. The pressurized incineration facility according to claim 1, wherein the seal device includes a jetting port which jets the seal gas to the rear surface of the turbine impeller toward an outer periphery of the turbine impeller.

7. The pressurized incineration facility according to claim 1, wherein the seal device includes a jetting port which jets the seal gas in a circular pattern coaxial with the turbine impeller to the rear surface of the turbine impeller.

8. The pressurized incineration facility according to claim 1, wherein the bearing housing is provided with a recess opening radially outward in cross-section along a central axis of the rotary shaft, and the jetting port of the seal device is configured to jet the seal gas to the rear surface of the turbine impeller toward an outer periphery of the turbine impeller by disposing the edge of the opening of the heat shield plate to face the recess.

9. A pressurized incineration method comprising steps of:

incinerating a processing object under a pressure increased by supplying a pressurized incinerator with compressed air produced by a turbocharger;

producing the compressed air by rotationally driving the turbocharger by combustion exhaust gas of the pressurized incinerator; and jetting seal gas to a rear surface of a turbine impeller of the turbocharger, wherein the turbocharger comprises:

a turbine housing accommodating the turbine impeller;

a bearing housing rotatably supporting a rotary shaft fixed to the turbine impeller; and a circular heat shield plate disposed between the turbine housing and the bearing housing and provided with an opening into which the rotary shaft is inserted, and wherein the seal gas is jetted to the rear surface of the turbine impeller from a jetting port of the seal device formed between the bearing housing and an edge of the opening of the heat shield plate.

10. The pressurized incineration method according to claim 9, wherein at the time of start-up of the pressurized incinerator, start-up air supplied from a blower is jetted to the rear surface of the turbine impeller such that the start-up air serves as the seal gas, and after start-up of the pressurized incinerator, the compressed air supplied from the turbocharger is jetted to the rear surface of the turbine impeller such that the compressed air serves as the seal gas.

11. The pressurized incineration method according to claim 9, wherein the bearing housing is provided with a recess opening radially outward in cross-section along a central axis of the rotary shaft, and the seal gas is jetted to the rear surface of the turbine impeller toward an outer periphery of the turbine impeller from the jetting port of the seal device formed by disposing the edge of the opening of the heat shield plate to face the recess.

* * * * *